US008683909B1

(12) United States Patent
Copus

(10) Patent No.: US 8,683,909 B1
(45) Date of Patent: Apr. 1, 2014

(54) MOUNTED GUN SUPPORT FOR HUNTING

(75) Inventor: William J. Copus, Mt. Horeb, WI (US)

(73) Assignee: Oak Sturdy, LLC, Mt. Horeb, WI (US)

( * ) Notice: Subject to any disclaimer, the term of this patent is extended or adjusted under 35 U.S.C. 154(b) by 341 days.

(21) Appl. No.: 12/965,279

(22) Filed: Dec. 10, 2010

Related U.S. Application Data

(60) Provisional application No. 61/285,871, filed on Dec. 11, 2009, provisional application No. 61/315,728, filed on Mar. 19, 2010, provisional application No. 61/394,098, filed on Oct. 18, 2010.

(51) Int. Cl.
*F41A 23/00* (2006.01)

(52) U.S. Cl.
USPC ..... 89/37.04; 42/94; 182/127; 248/219.4

(58) Field of Classification Search
USPC ..... 89/37.04; 182/187; 42/94; 248/219.4
See application file for complete search history.

(56) References Cited

U.S. PATENT DOCUMENTS

| | | | | | |
|---|---|---|---|---|---|
| 3,022,898 | A * | 2/1962 | Loeb | 211/64 |
| 3,358,789 | A * | 12/1967 | Laun | 182/113 |
| 4,069,891 | A * | 1/1978 | McClung | 182/187 |
| 4,325,529 | A * | 4/1982 | Seebinger | 248/218.4 |
| 4,409,907 | A * | 10/1983 | Norton | 108/152 |
| 4,582,168 | A * | 4/1986 | Frey | 182/187 |
| 4,641,727 | A * | 2/1987 | McKelvy | 182/46 |
| 4,721,183 | A * | 1/1988 | Koniecka | 182/187 |
| 5,199,527 | A * | 4/1993 | Jennings | 182/187 |
| 5,482,241 | A * | 1/1996 | Oglesby | 248/309.1 |
| 5,491,920 | A * | 2/1996 | McCullers | 42/94 |
| 5,497,214 | A * | 3/1996 | Labree | 396/428 |
| 5,515,943 | A * | 5/1996 | Antonelli | 182/187 |
| 5,622,342 | A * | 4/1997 | Mills | 248/126 |
| 5,685,103 | A * | 11/1997 | Wiggins | 42/94 |
| 5,723,808 | A * | 3/1998 | Devall | 89/37.04 |
| 5,769,372 | A * | 6/1998 | Klosterman | 248/219.4 |
| 6,003,632 | A * | 12/1999 | Miller | 182/116 |
| 6,029,386 | A * | 2/2000 | Globig | 42/94 |
| 6,202,964 | B1 * | 3/2001 | Thornhill | 248/219.4 |
| 6,349,905 | B1 * | 2/2002 | Mills | 248/126 |
| 6,390,239 | B1 * | 5/2002 | McClain | 182/187 |
| 6,694,661 | B1 * | 2/2004 | Langford | 42/94 |
| 6,722,472 | B2 * | 4/2004 | Berkbuegler | 182/187 |
| 6,726,163 | B2 * | 4/2004 | Eppard et al. | 248/219.4 |

(Continued)

OTHER PUBLICATIONS

Matthews Summer/Fall 2010 Catalogue (2 pages).

*Primary Examiner* — Michelle Clement
(74) *Attorney, Agent, or Firm* — Charles S. Sara, Esq.; DeWitt Ross & Stevens S.C.

(57) ABSTRACT

An exemplary hunting rifle support includes a mounting bracket mountable to a tree using a strap extending through apertures. A gun can be supported above or be hung below the appendages of a support arm that pivotally extends out from the mounting bracket. Support flanges extending from a mounting bracket base allow for upright and stable mounting to support structures, and gripping flanges resist tilting from the swiveling of the support arm. Fasteners extending to varying degrees through opposing support flanges rotate the mounting bracket with respect to the mounted tree. A pair of primary flanges extending from the mounting bracket base forms a primary valley, and a secondary flange between the primary flanges forms a secondary valley, the valleys able to complementarily receive portions of the support arm. A barrel support member extending above the support arm stabilizes the gun as the hunter aims at a target.

22 Claims, 9 Drawing Sheets

(56) References Cited

U.S. PATENT DOCUMENTS

| | | | | |
|---|---|---|---|---|
| 6,948,690 | B1 * | 9/2005 | Sandel | 248/218.4 |
| 7,188,445 | B2 * | 3/2007 | Lehman | 42/94 |
| 7,454,859 | B2 * | 11/2008 | Buckner | 42/94 |
| 7,549,247 | B1 * | 6/2009 | Reese | 42/94 |
| 7,658,140 | B2 * | 2/2010 | Lombardi | 89/37.04 |
| 7,770,319 | B2 * | 8/2010 | McDonald | 42/94 |
| 7,789,574 | B2 * | 9/2010 | Broberg | 396/428 |
| 7,958,663 | B2 * | 6/2011 | Saunders, III | 42/94 |
| 7,958,968 | B1 * | 6/2011 | Stabler | 182/187 |
| 8,087,195 | B2 * | 1/2012 | Minges | 42/94 |
| 8,292,041 | B1 * | 10/2012 | Shull | 188/65.4 |
| 2003/0038218 | A1 * | 2/2003 | Eppard et al. | 248/219.4 |
| 2004/0216351 | A1 * | 11/2004 | Eppard et al. | 42/94 |
| 2005/0246935 | A1 * | 11/2005 | Northrup | 42/94 |
| 2006/0137233 | A1 * | 6/2006 | Meeks | 42/94 |
| 2006/0231707 | A1 * | 10/2006 | Schrot | 248/218.4 |
| 2007/0000163 | A1 * | 1/2007 | Buckner | 42/94 |
| 2008/0169156 | A1 * | 7/2008 | Leishman et al. | 182/187 |
| 2009/0064560 | A1 * | 3/2009 | Saunders, III | 42/94 |
| 2009/0129769 | A1 * | 5/2009 | Broberg | 396/428 |
| 2009/0321489 | A1 * | 12/2009 | Gates et al. | 224/531 |
| 2010/0018102 | A1 * | 1/2010 | Minges | 42/94 |
| 2010/0040360 | A1 * | 2/2010 | Scott | 396/428 |
| 2010/0251592 | A1 * | 10/2010 | Otto | 42/94 |
| 2010/0314514 | A1 * | 12/2010 | Nelson | 248/219.1 |
| 2011/0049315 | A1 * | 3/2011 | Buckbee | 248/219.4 |
| 2011/0083399 | A1 * | 4/2011 | Lettkeman et al. | 52/745.21 |
| 2011/0265367 | A1 * | 11/2011 | Saunders, III | 42/94 |
| 2011/0302819 | A1 * | 12/2011 | McGhan | 42/94 |
| 2011/0308887 | A1 * | 12/2011 | Johnson | 182/187 |
| 2012/0160791 | A1 * | 6/2012 | Muldoon et al. | 211/64 |
| 2012/0162044 | A1 * | 6/2012 | Lettkeman et al. | 343/880 |
| 2013/0025178 | A1 * | 1/2013 | Blitch | 42/94 |

* cited by examiner

MOUNTED GUN SUPPORT FOR HUNTING

CROSS-REFERENCE TO RELATED APPLICATIONS

This application claims priority under 35 USC §119(e) to U.S. Provisional Patent Applications 61/285,871 filed Dec. 11, 2009, 61/315,728 filed Mar. 19, 2010, and 61/394,098 filed Oct. 18, 2010, the entireties of which are incorporated by reference herein.

FIELD OF THE INVENTION

This document concerns an invention relating generally to a gun support mountable to a tree while hunting.

BACKGROUND OF THE INVENTION

Hunters often position themselves on a platform and/or seat attached to a tree (for example, tree stand or tree seat) while scanning the surroundings for prey. Tree stands and tree seats help conceal and comfort the hunter while awaiting targets, aiming, and shooting. They can provide an improved vantage point, reduce human odor that can alert potential game of the hunter's presence, and allow for greater movement without alerting prey to the hunter's position. While in the tree stand, however, the hunter often supports his/her weapon (gun, bow, etc.) on his upper body while seeking, aiming at, and shooting at prey, something that can quickly become tiring.

Some hunters hang their weapons and equipment on an arm mounted to the tree, but such mounted arms suffer from many shortcomings. They are often not strong enough to hold the weight of the weapon, and the hunter thus is required to expend energy supporting the weapon while hunting, or resting the weapon on the tree stand or ground when not in use. They generally do not provide stable support for the gun, instead requiring the hunter to remain particularly still while aiming and firing the hanging weapon. The arms tend not to be maneuverable, limiting the sightlines of the hunter. The mounts used to attach the arms to the tree often are not resistant to rotation and tilting, particularly as forces are applied to the arm. They also tend to be too heavy and bulky for easy transportability, especially as hunters often travel long distances over difficult terrain in search of game animals.

What is needed is a lightweight and compact gun support that is strong and stable, and versatile enough to accommodate a variety of weapons and other equipment/accessories in a variety of configurations and locations.

SUMMARY OF THE INVENTION

The invention, which is defined by the claims set forth at the end of this document, is directed to a gun support for use while hunting which at least partially alleviates the aforementioned problems. A basic understanding of some of the features of preferred versions of the invention can be attained from a review of the following brief summary of the invention, with more details being provided elsewhere in this document. To assist in the reader's understanding, the following review makes reference to the accompanying drawings (which are briefly reviewed in the "Brief Description of the Drawings" section following this Summary section of this document).

Referring initially to FIGS. 1 and 2, an exemplary gun support 10 includes a mounting bracket 100 mountable to a support structure 15 (such as a tree) using a mounting strap 20, and a support arm 200 extending out from the mounting bracket 100. The support arm 200 can support a gun 25 (such as a hunting rifle) using an overhead gun support 300 or a hanging gun support 400. If the overhead gun support 300 is used while hunting, a barrel 30 of the gun 25 is supported above the support arm 200 as the gun 25 is aimed. If the hanging gun support 400 is used, the barrel 30 hangs below the support arm 200 while the gun 25 is being aimed. The support arm 200 rotates with respect to the mounting bracket 100, allowing a hunter 35 to stably swivel the support arm 200 while aiming the gun 25.

The mounting bracket 100 includes a mounting bracket base 105A having a base front surface 105B and an opposing base back surface 105C (see FIG. 3B). A pair of primary flanges 110A, 110B extending from the base front surface 105B defines a primary valley 110C (with a height of, e.g., 2.5 inches or greater), and a secondary flange 115A extending from the base front surface 105B between the primary flanges 110A, 110B defines a smaller secondary valley 115B (with a height of, e.g., 0.625 inches or greater) within the primary valley 110C. The primary and secondary flanges 110A, 110B, 115A complementarily receive portions of the support arm 200 in various configurations, as discussed below. A pair of spaced strap apertures 120A, 120B formed in the mounting bracket base 105A, each strap aperture extending from the base front surface 105B to the base back surface 105C, may be provided between the primary flanges 110A, 110B and on opposing sides of the secondary flange 115A. The mounting strap 20 removably secures the mounting bracket 100 to the support structure 15 by being extended through the pair of strap apertures 120A, 120B and around the support structure 15 on which the mounting bracket 100 is mounted.

To enhance stability when the mounting bracket 100 is mounted to the support structure 15, an upper pair of support flanges 125A, 125B and a lower pair of support flanges 130A, 130B may extend upwards and downwards, respectively, from opposing sides of the mounting bracket base 105A. Each of the upper pair of support flanges 125A, 125B may be angled away from the base front surface 105B and the primary flanges 110A, 110B (toward the support structure 15), while each of the lower pair of support flanges 130A, 130B may be coplanar with the mounting bracket base 105A. A pair of threaded support flange apertures 135A, 135B formed in the lower pair of support flanges 130A, 130B allows each of the lower pair of support flanges 130A, 130B to receive a threaded leveling fastener 135C therethrough. By extending the threaded leveling fasteners 135C through the threaded support flange apertures 135A, 135B to varying degrees, the mounting bracket 100 can be tilted/rotated with respect to the support structure 15 when the mounting bracket 100 is mounted to the support structure 15. Gripping projections 140A, 140B extending back from the base back surface 105C on opposing sides of the mounting bracket base 105A help further stabilize the mounting bracket 100 when the mounting bracket 100 is mounted to the support structure 15. The support flanges 125A, 125B, 130A, 130B, leveling fasteners 135C, and gripping projections 140A, 140B help the mounting bracket 100 conform to the varying contours of different support structures 15 in varying configurations.

The support arm 200 extending from the mounting bracket 100 may include an inner appendage 205, an outer appendage 215, and two middle appendages 210A, 210B sandwiching portions of the inner and outer appendages 205, 215. The inner appendage 205 may include a support arm bracket 225A with a pair of opposing support arm bracket apertures 225B formed therein. An elongated pin 145A extending through the primary flange apertures 112A, 112B and the support arm bracket apertures 225B may be used to pivotally secure the inner appendage 205 to the mounting bracket 100. Because the secondary flange 115A extends out from the base front surface 105B to a lesser distance than the pair of primary flanges 110A, 110B, the elongated pin 145A is not obstructed by the secondary flange 115A from extending between the primary flanges 110A, 110B. A locking member 155 (such as a ball detent) provided in the elongated pin 145A allows the elongated pin 145A to be replaceably locked into position, keeping the inner appendage 205 and the support arm bracket 225A together. The middle appendages 210A, 210B may be pivotally secured to the inner and outer appendages 205, 215, allowing the middle appendages 210A, 210B to rotate with respect to both the inner and outer appendages 205, 215.

The inner 205, middle 210A, 210B, and outer appendages 215 of the support arm 200 may have the same width. By spacing the primary flanges 110A, 110B from each other by a distance at least three times the width of the support arm appendages 205, 210A, 210B, 215, portions of support arm appendages 205, 210A, 210B, 215 may be complementarily received within the primary valley 110C of the mounting bracket 100 (see FIGS. 4A and 4B). The secondary flange 115A may be spaced from one of the primary flanges 110A, 110B by a distance substantially equal to the width of one of the support arm appendages 205, 210A, 210B, 215 so that the secondary valley 115B can complementarily receive one of the support arm appendages 205, 210A, 210B, 215 (see FIG. 7). As a result of the spacing, the secondary valley 115B may have approximately one-third of the width of the primary valley 110C.

To position the gun 25 above the support arm 200, a barrel support member 305A extending upwards from the outer appendage 215 is provided, the barrel support member 305A configured to complementarily receive the barrel 30 of gun 25 and limit the movement thereof on top of the support arm 200. An accessory appendage 315 extending from the barrel support member 305A may be used to secure a camera 325 pointed in the direction of the gun barrel 30. To position the gun 25 below the support arm 200, two spaced strap brackets 405, 406 may be removably secured to the outer appendage 215. The barrel 30 of the gun 25 may be rested on a resting member 440 with a resting member valley 442 formed therein, the valley 442B configured to complementarily receive the gun barrel 30. Two hanging straps 445A, 445B may extend between opposing ends of the resting member 440 to form a loop with the resting member 440, and each hanging strap 420A, 420B may be removably secured to the outer appendage 215 via one of the strap brackets 405, 406.

The exemplary mounting bracket 100 allows left- and right-handed hunters 35 to securely mount the support arm 200 to a variety of support structures 15 having differing dimensions. The mounting bracket 100 is able to support relatively great weights while maintaining a relatively smaller size, making it easier to stow and transport, and requiring less raw material to manufacture. Especially when used with a tree stand, the gun support 10 simulates a table-top bench rest that allows the hunter 35 to aim at targets behind and below the mounting bracket 100, with the support arm 200 swiveling into position when needed and out of the way when not needed. When not needed, the gun support 10 maintains the gun 25 in a ready-to-aim orientation without unnecessarily tiring the hunter 35 having to keep holding the gun 25.

The gun support 10 can be used while standing on the ground, with tree stands, or with ladder stands. When using a tree stand without a safety rail, the hunter 35 is able to feel safer with the support arm 200 nearby, as he/she can swing the support arm 200 in front of himself and place his hands and/or arms thereon when desired. The gun support 10, which can be used with scoped and non-scoped rifles, shotguns, pistols, muzzle loaders, cross bows, etc., provides a resting place for stowing weapons for extended periods of time. The support arm 200 can be folded to fit into a backpack or for easy carrying (see FIGS. 4A and 4B). Because the elongated pin 145A allows the support arm 200 to be conveniently separated from the mounting bracket 100, the hunter 35 is able to readily change locations by unpinning the support arm 200, moving to another tree 15 with a mounting bracket 100 already mounted thereto, and pinning the support arm 200 to the new mounting bracket 100. Further advantages and features of the invention will be apparent from the remainder of this document in conjunction with the associated drawings.

DETAILED DESCRIPTION OF PREFERRED VERSIONS OF THE INVENTION

Figure 1:
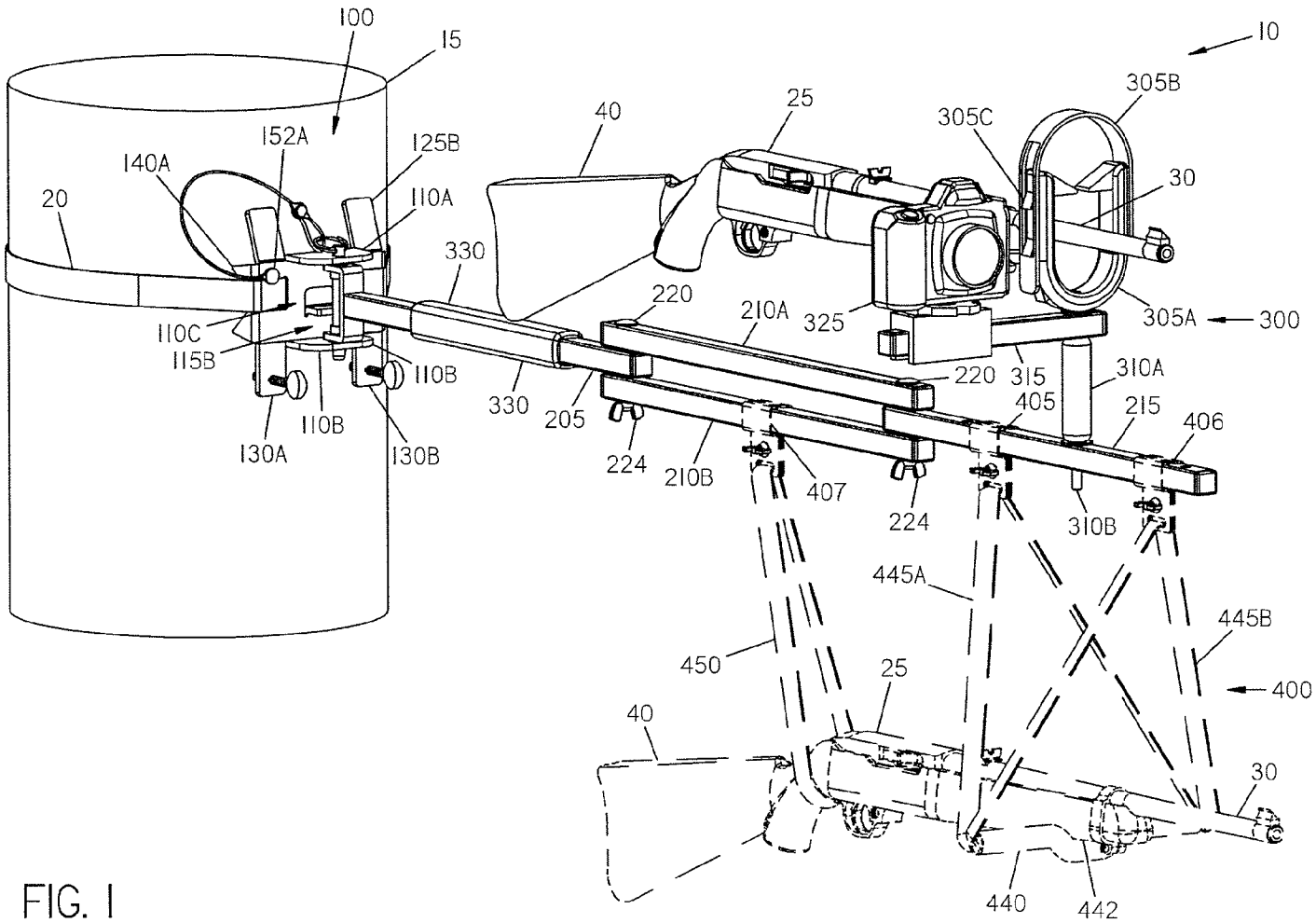
FIG. 1 shows an exemplary gun support 10 with a mounting bracket 100 secured to a support structure 15 using a mounting strap 20, with a gun 25 resting over a support arm 200, and a phantom gun (not in simultaneous use with the overhead gun) hanging below the support arm 200.
Figure 2:
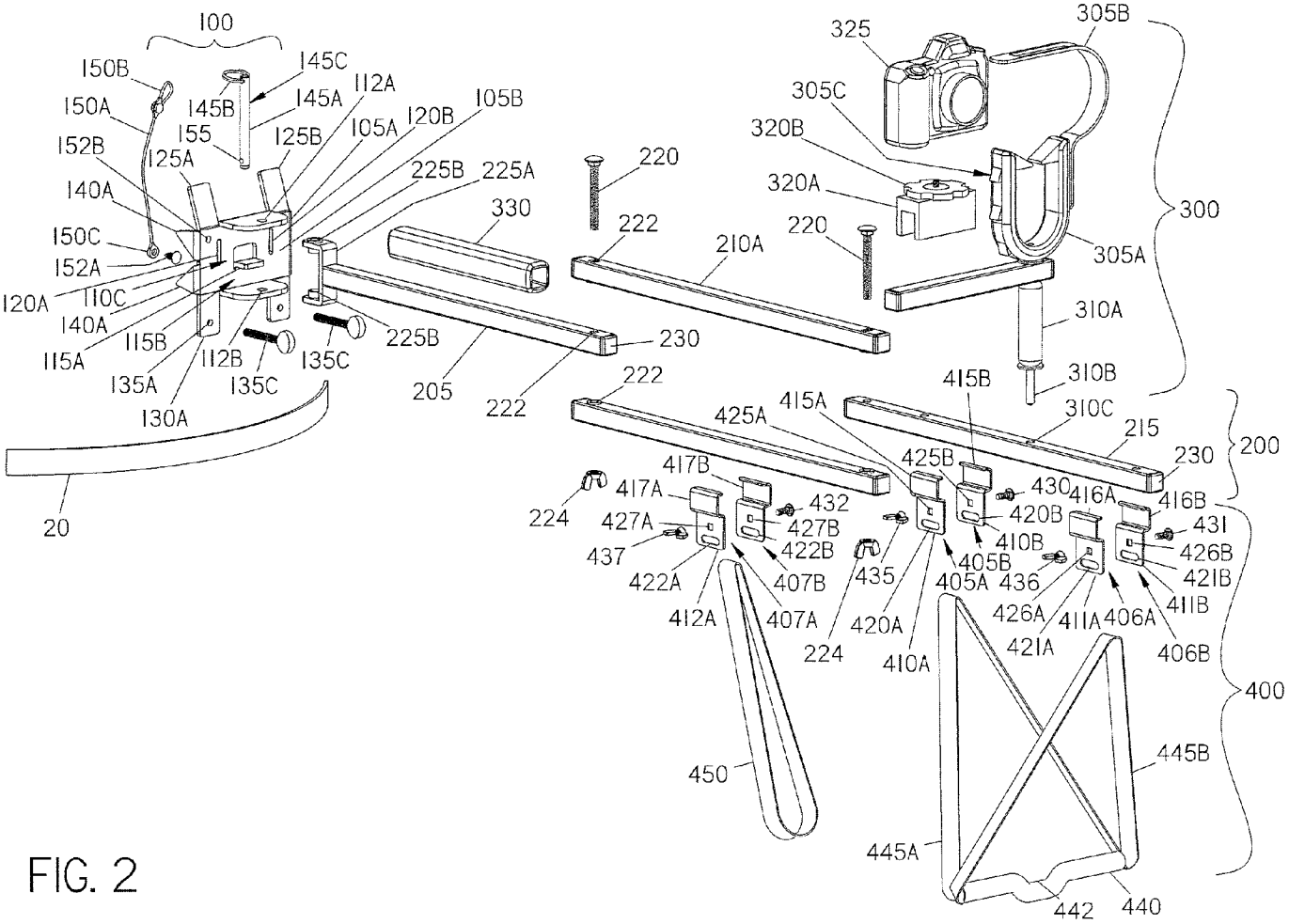
FIG. 2 shows an exploded view of the various parts of the exemplary gun support 10 of FIG. 1.

Returning to FIGS. 1 and 2, the mounting bracket 100 is preferably made of a strong metal or metal alloy to withstand the forces imposed thereon (such as by the weights added to the support arm 200). A thickness of approximately 0.1875 inches for the mounting bracket base 105A and extensions therefrom (such as the primary 110A, 110B, secondary 115A, support 125A, 125B, 130A, 130B, and gripping 140A, 140B flanges) would provide substantial strength despite the relatively smaller dimensions of the mounting bracket 100. The rectangular mounting bracket base 105A may have, for example, a width of approximately five inches and a height of approximately three inches, with the primary flanges 110A, 110B also spaced approximately three inches apart (providing the primary valley 110C with a height of approximately 2.625 inches, or approximately three inches minus the thickness of the primary flanges 110A, 110B). The secondary flange 115A may be spaced approximately one inch from the lower primary flange (forming a secondary valley 115B having a height of approximately 0.8125 inches, or approximately one inch minus the thickness of the secondary flange 115A), allowing a single support arm 200 appendage (which commonly has a rectangular shape with a width of approximately 0.8125 inches) to laterally slide therethrough (see FIG. 7). A hunter 35 may hang hunting equipment from a laterally-installed support arm 200, as further discussed below.

Figure 3A:
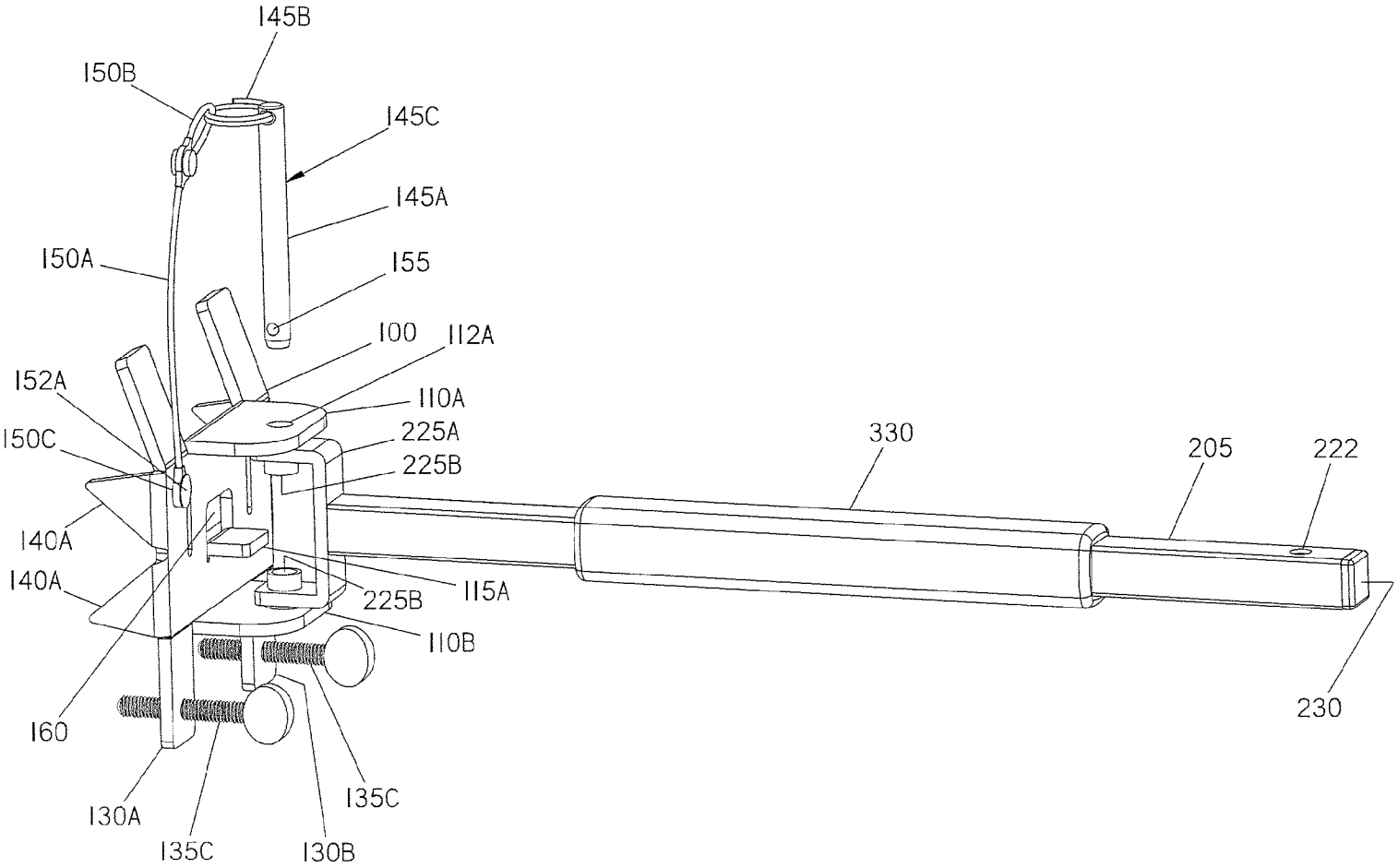
FIG. 3A shows the mounting bracket 100 and inner appendage 205 of FIG. 1, with elongated pin 145A removed from primary flanges 110A, 110B and support arm bracket 225A.
Figure 3B:
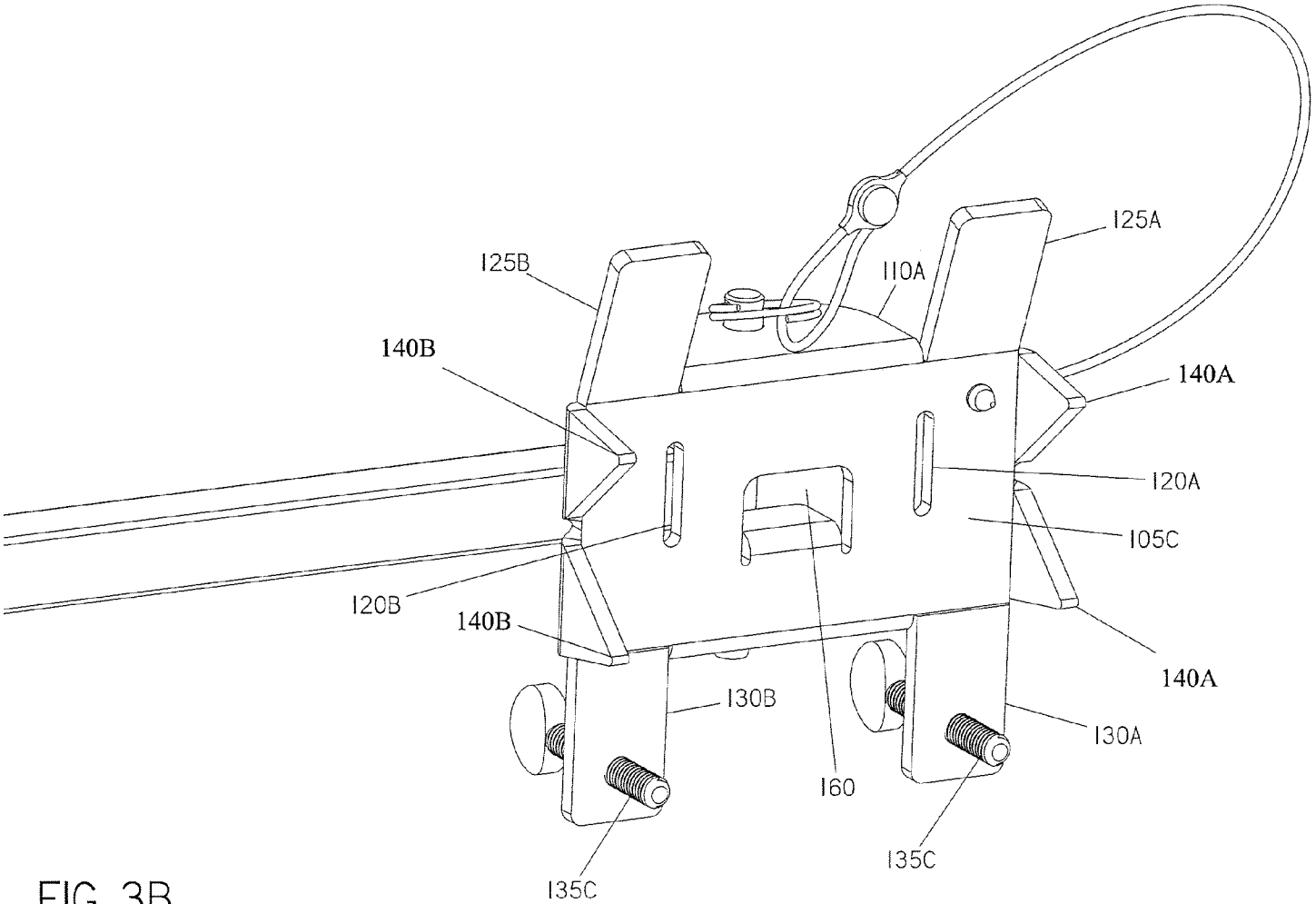
FIG. 3B shows the back side (displaying the base back surface 105C) of the mounting bracket 100 of FIG. 3A, with elongated pin 145A inserted through the primary flange apertures 112A, 112B and support arm bracket apertures 225B.
Figure 4A:
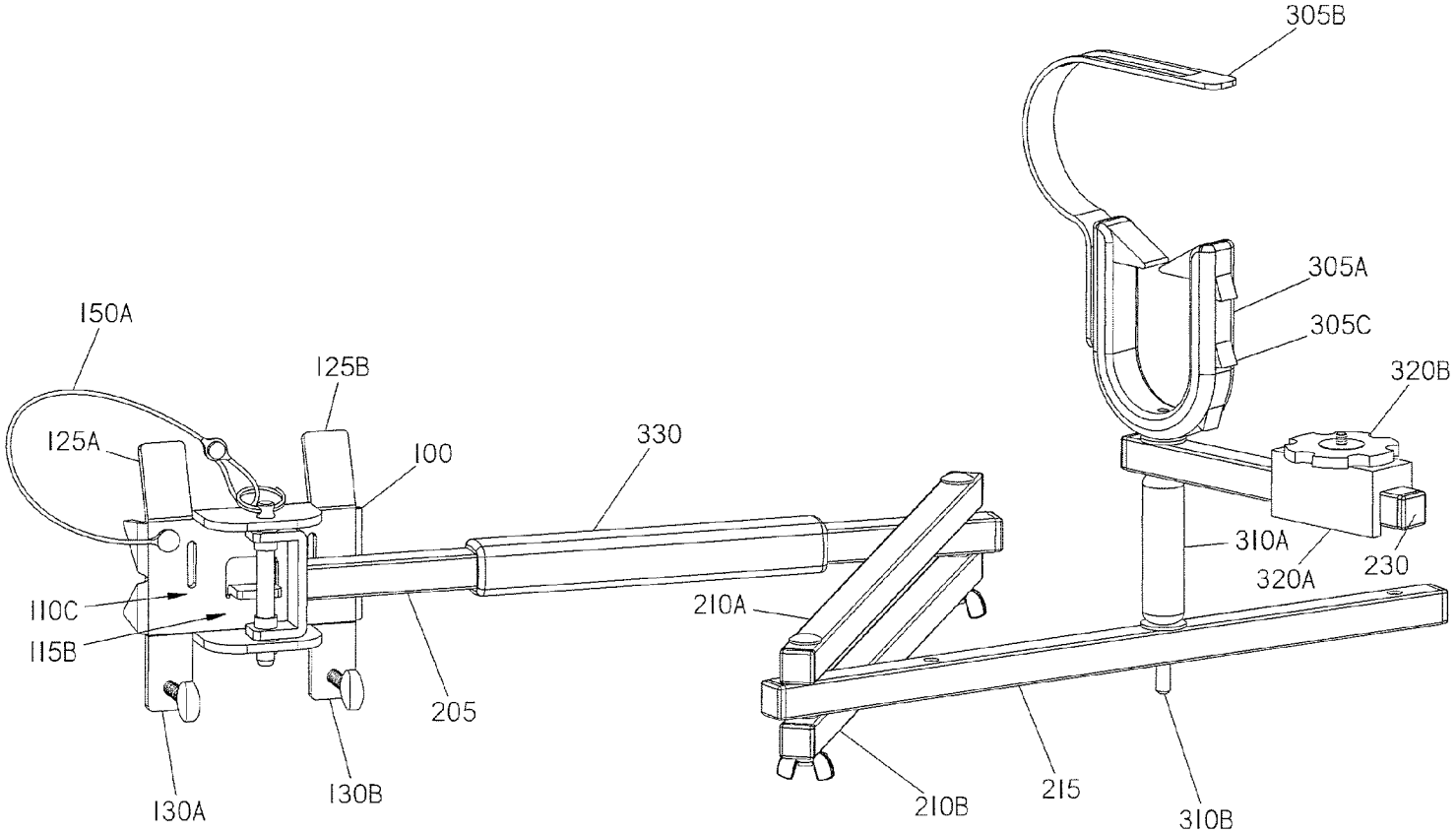
FIG. 4A shows the gun support 10 of FIGS. 1 and 2 with the inner appendage 205 swiveled 180 degrees with respect to the mounting bracket 100, and the middle and outer appendages 210A, 210B, 215 of the support arm 200 swiveled to bring the barrel support member 305A closer to the mounting bracket 100.
Figure 4B:
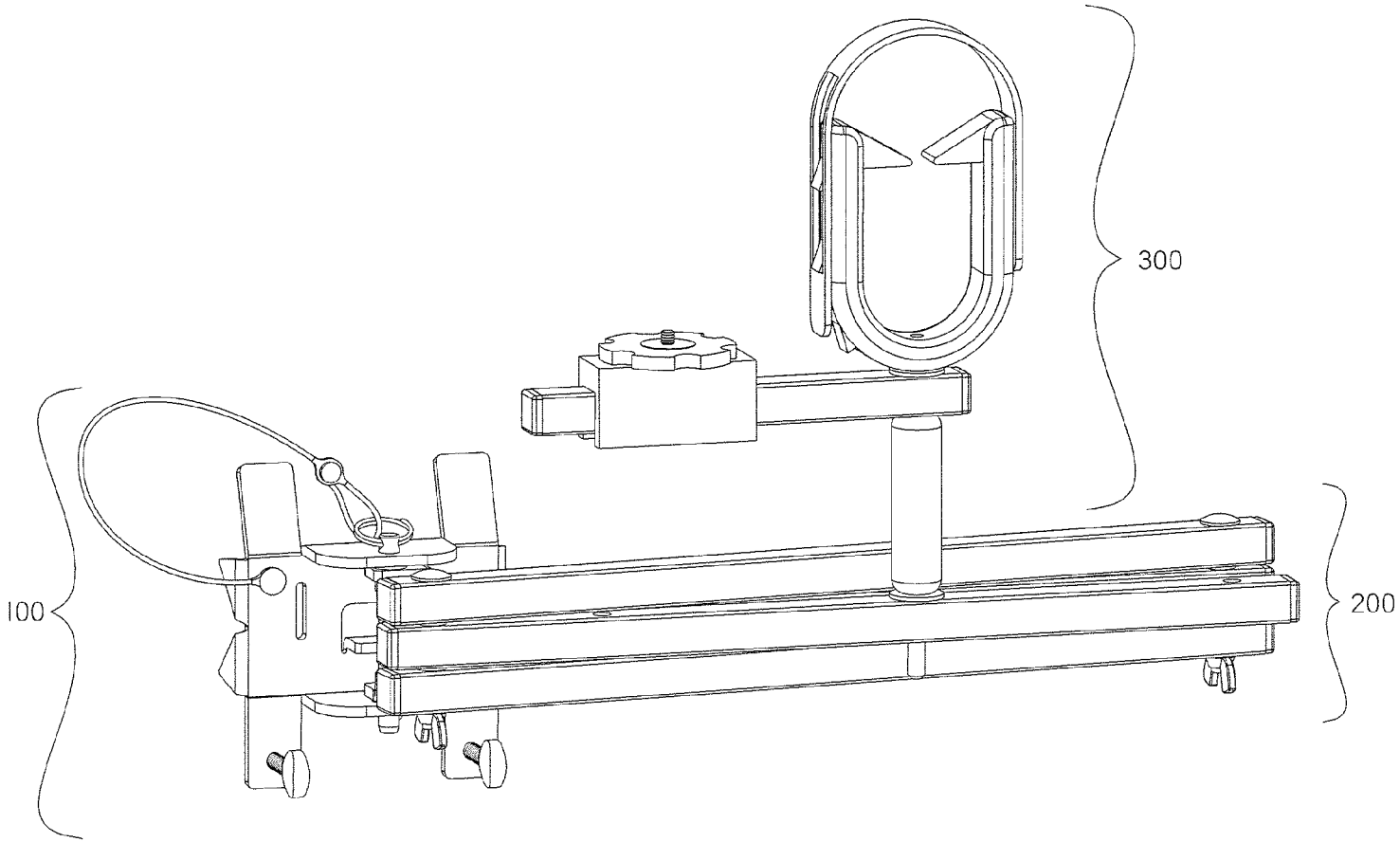
FIG. 4B shows the gun support 10 of FIG. 4A with the support arm 200 folded into a stowed and easily transportable position, with portions of the inner, middle, and outer appendages 205, 210A, 210B, 215 received within the primary and secondary valleys 110C, 115B.

The primary flanges 110A, 110B may perpendicularly extend approximately 1.5 inches from the mounting bracket base 105A, with the secondary flange 115A extending approximately 0.5 inches out from the mounting bracket base 105A. Because the primary flange apertures 112A, 112B are situated farther out than the 0.5-inched secondary flange 115A (such as approximately 0.75 inches from the mounting bracket base 105A, with a diameter of approximately 0.375 inches), the secondary flange 115A does not obstruct the elongated pin 145A extending between the primary flange apertures 112A, 112B. The support flanges 125A, 125B, 130A, 130B may extend out approximately 1.75 inches from the mounting bracket base 105A, with a width of approximately one inch (and each threaded support flange aperture 135A, 135B in the lower pair of support flanges 130A, 130B having a diameter of approximately 0.25 inches). The strap apertures 120A, 120B may have a height of approximately one inch and a width of approximately 0.1875 inches, and the gripping projections 140A, 140B may extend approximately an inch from the mounting bracket base 105A. A rectangular base window 160 formed in the mounting bracket base 105A (extending from the base front surface 105B to the base back surface 105C) may have a height of approximately one inch and a width of approximately 0.75 inches (see FIGS. 3A and 3B). The base window 160 may be used, for example, when handling/transporting the mounting bracket 100 by inserting one or more fingers therethrough. The base window 160 also allows for easier viewing of the opposing side of the mounting bracket 100.

The mounting bracket 100 can be stably secured to the tree 15 (or other support structure 15) using one mounting strap 20 (such as an endless ratchet strap or a strap sewn onto a cam buckle, allowing easy adjustment of the length of the mounting strap 20), and does not need to be bolted, nailed, or screwed to the tree 15 for stability. The pair of strap apertures 120A, 120B in the mounting bracket base 105A help hold the mounting strap 20 and the mounting bracket 100 together as the mounting bracket 100 is transported and mounted to the tree 15. Four support flanges 125A, 125B, 130A, 130B extend from the four corners of the rectangular mounting bracket base 105A to help engage the tree 15, conform to variable contours, and maintain the orientation of the mounting bracket 100 with respect to the tree 15. The angling of the upper pair of support flanges 125A, 125B can counterbalance the inward bias provided by the mounting strap 20, helping keep the mounting strap 20 taut. The threaded leveling fasteners 135C extending through the lower pair of support flanges 130A, 130B allow for a variable degree of engagement with the tree 15 and rotation with respect thereto. It is noted that the leveling fasteners 135C do not screw into the tree 15 but press against it. The triangular gripping projections 140A, 140B extending from the back of the mounting bracket base 105A engage the tree 15 and resist tipping of the mounting bracket 100, particularly when the support arm 200 is being swiveled leftward and rightward across its full pivoting range. As such, the mounting bracket 100 may be mounted on virtually any support structure 15, even if the support structure 15 is slanted, and the support arm 200 may be maintained level while hunting without tipping, twisting, bending, or breaking.

The elongated pin 145A, with a length of approximately 3.75 inches (and a diameter approximately matching the diameter of the primary flange apertures 112A, 112B), is used to replaceably secure the inner appendage 205 of the support arm 200 with the mounting bracket 100. On opposing ends of the elongated pin 145A are the locking member 155 and a locking ring 145B, with the locking member 155 situated approximately 3.5 inches from the top of the elongated pin 145A. So that the elongated pin 145A is kept with the mounting bracket 100, a lanyard 150A tethers the elongated pin 145A to the mounting bracket 100. On opposing ends of the lanyard 150A are a lanyard fastener aperture 150C for receiving a lanyard fastener 152A, and a lanyard loop 150B for engaging the locking ring 145B of the elongated pin 145A. The lanyard 150A is secured to the mounting bracket 100 by extending the lanyard fastener 152A through the lanyard fastener aperture 150C and a tethering aperture 152B formed in the mounting bracket base 105A, the tethering aperture 152B extending from the base front surface 105B to the base back surface 105C. The ball detent serving as the locking member 155 is spring loaded to be biased outward, protruding beyond an elongated pin front surface 145C. To install or remove the elongated pin 145A from the primary flanges 110A, 110B, the ball detent 155 is pressed inward by the primary flanges 110A, 110B as the ball detent 155 begins to pass through the primary flange apertures 112A, 112B. Once the ball detent 155 has passed through the primary flange apertures 112A, 112B, it again protrudes from the elongated pin outer surface 145C, again resisting passage through the primary flange apertures 112A, 112B.

To secure the support arm 200 to the mounting bracket 100, the elongated pin 145A may be inserted through two oil impregnated brass bushings provided at the support arm bracket apertures 225B of the inner appendage 205. The inner appendage 205, on an end opposing the support arm bracket 225A, includes an inner appendage fastener aperture 222. Opposing ends of each of the middle and outer appendages 210A, 210B, 215 include a pair of middle and outer appendage fastener apertures 222 formed therein. The inner, middle, and outer appendages 205, 210A, 210B, 215 are secured to each other using a pair of appendage fasteners 220 (each of which may have a pressed-in bushing) extending through the appendage fastener apertures 222, and the appendage fasteners 220 are secured to the support arm 200 by screwing appendage wing nuts 224 about the appendage fasteners 220 on an opposing side of the appendages 205, 210A, 210B, 215. The elongated pin 145A allows the inner appendage 205 to pivot over a range of 180 degrees with respect to the mounting bracket 100, and appendage fasteners 220 allow the inner and outer appendages 205, 215 to swivel with respect to the middle appendages 210A, 210B over a range approaching 360 degrees (i.e., rotating until the appendages collide with each other). The middle and outer appendages 210A, 210B, 215 are each provided with two plastic end caps 230 on opposing ends to keep moisture out of the appendages, and the inner appendage 205 is provided with one end cap 230 on the end opposing the support arm bracket 225A. The accessory appendage 315 is also provided with end caps 230 at opposing ends.

Figure 5:
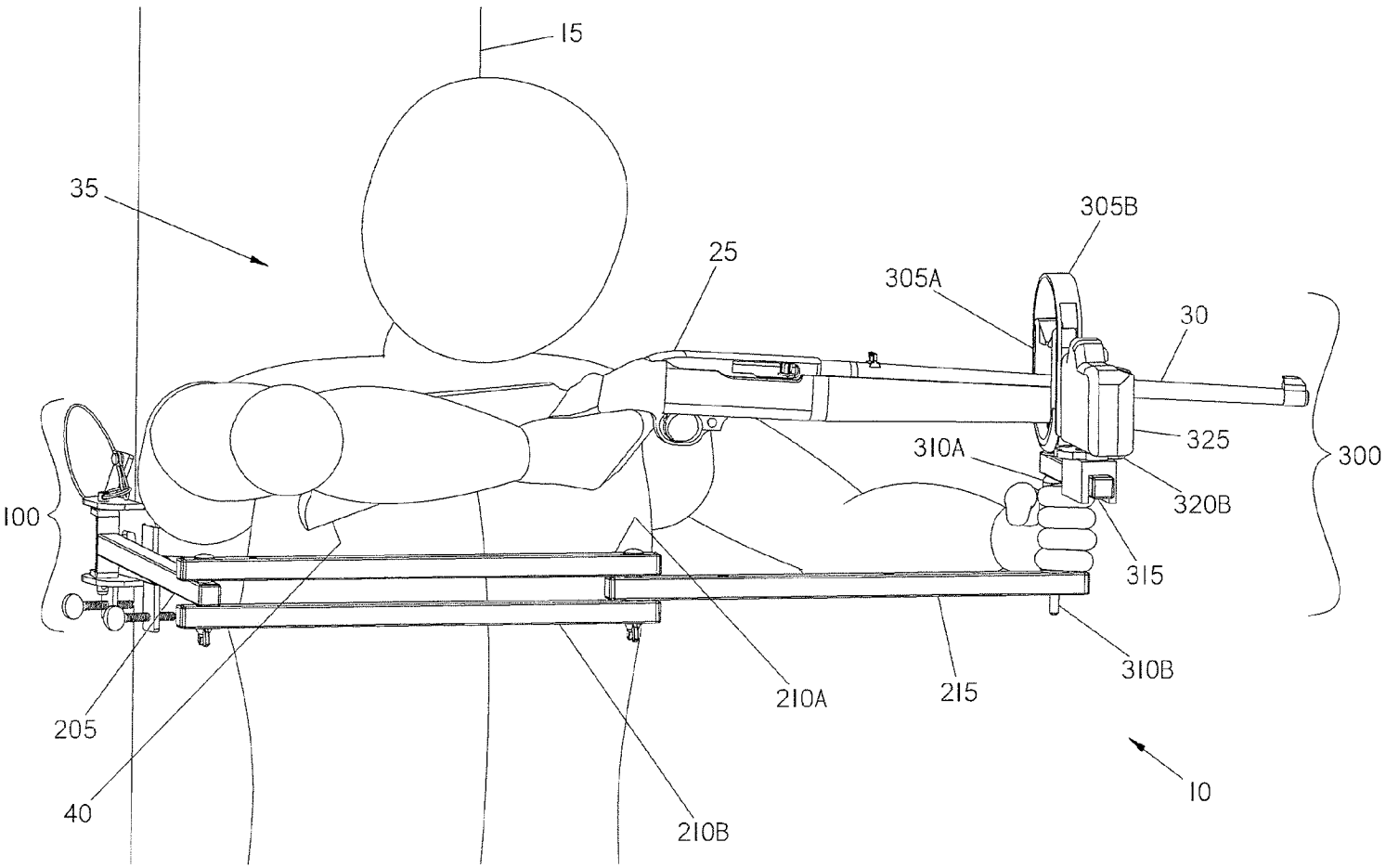
FIG. 5 shows the overhead gun support 300 of FIG. 1 being used by a hunter 35 to aim the gun 25 at a target.

Referring to FIG. 5, to use the overhead gun support 300, the hunter 35 secures the mounting bracket 100 to the tree 15 using the mounting strap 20, and installs the support arm 200 onto the mounting bracket 100 using the elongated pin 145A. The barrel support member 305A may extend approximately six inches above the outer appendage 215. A securing band 305B (made of, e.g., rubber) is affixed to a first side of the barrel support member 305A and replaceably extends over the opening of the barrel support member 305A to an opposing side thereof, the securing band 305B able to cover the top opening of the barrel support member 305A and latch onto a securing tab 305C to help keep the barrel 30 of the gun 25 within the barrel support member 305A (see FIGS. 1 and 2). Extending from the barrel support member 305A are a support member grip 310A and a support member flange 310B. The cylindrical support member grip 310A, which may be wrapped with foam for enhanced gripping, is replaceably held in place over the support arm 200 by inserting the support member flange 310B through an accessory aperture 310C formed in the outer appendage 215.

Once the barrel 30 is situated on the barrel support member 305A, the hunter 35 may lift a buttstock 40 of the hunting rifle 25 and press it against his or her bicep or shoulder, grip the support member grip 310A, and pivot the support arm 200 in the direction of the target. The hunter 35 may also rest an arm on the support arm 200 (such as on the middle appendages 210A, 210B) for added stability while aiming and firing of the gun 25. The inclusion of two middle appendages 210A, 210B adds strength and stability to the gun support 10 as the support arm 200 supports the weight of the gun 25 and/or the weight of the hunter's 35 arms. If a fleeing animal is being targeted, the gun support 10 allows the hunter 35 to keep the scope on the kill zone by swinging the support arm 200 on plane with the animal as it runs, helping the hunter 35 make particularly difficult shots. If the animal is under the tree stand, the hunter 35 can stand up (while leaving the gun 25 in the barrel support member 305A) and aim down toward the animal. The accessory appendage 315 perpendicularly extends from the barrel support member 305A. A camera mount 320A having a camera mount rotating member 320B can be rotatably secured to the accessory appendage 315, and the camera 325 can be pointed forward (or rotated to another desired direction by rotating the camera mount rotating member 320B with respect to the camera mount 320A) so that its field of view continues to include the area of interest (such as the direction in which the barrel 30 of the gun 25 is aimed) as the appendages of the support arm 200 are pivoted.

The support provided by the support arm 200 helps the hunter 35 hold onto the gun 25 for extended periods of time without tiring while waiting for (or aiming at) prey. When not using the gun 25, the hunter 35 can swing the support arm 200 to the left or right to clear his or her field of view, and when needed the hunter 35 can swing the support arm 200 back and aim the gun 25. The hunter 35 may also rest the buttstock 40 of the gun 25 on a cylindrical rear gun rest 330 that slides over the inner appendage 205 when the gun 25 is not being used. The rear gun rest 330 may be wrapped in foam (or other irregular surface providing frictional forces) to resist slippage with the buttstock 40 when rested thereon.

Figure 6:
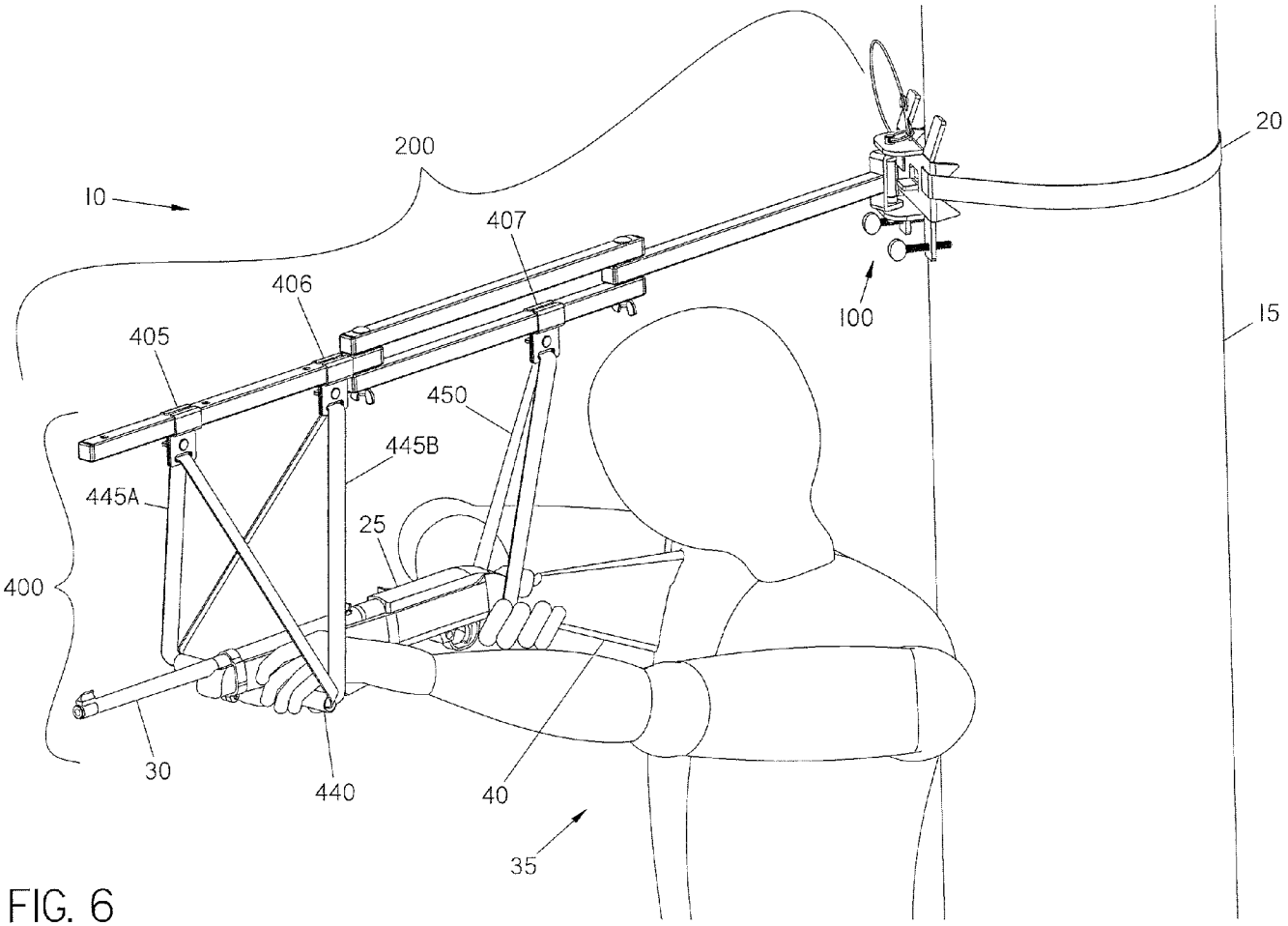
FIG. 6 shows the hanging gun support 400 of FIG. 1 being used by the hunter 35 of FIG. 5 to aim the gun 25 at a target.

Referring to FIG. 6, to use the hanging gun support 400, the hunter 35 again mounts the mounting bracket 100 to the tree 15. Each of the spaced strap brackets 405, 406 includes two strap bracket halves 405A/405B, 406A/406B, respectively, and each strap bracket half includes a strap bracket hanging portion 415A/415B, 416A/416B extending from a strap bracket appendage portion 410A/410B, 411A/411B (see FIG. 2). Each strap bracket half also includes a strap bracket strap aperture 420A/420B, 421A/421B and a strap bracket fastener aperture 425A/425B, 426A/426B. The strap bracket halves are secured to each other and to the outer appendage 215 using a strap bracket fastener 430, 431 extending through the strap bracket fastener apertures 425A/425B, 426A/426B, and a strap bracket wing nut 435, 436 screwed about the strap bracket fastener 430, 431. The resting member 440 is a flexible tubular plastic wrapped with foam (or other irregular surface providing frictional forces), and the resting member valley 442 formed therein is able to cradle the barrel 30 of the gun 25 with minimal slippage therewith. The two hanging straps 445A, 445B extend through the tubular resting member 440 to form a loop with the resting member 440, and each hanging strap 445A, 445B extends through the strap bracket strap apertures 420A/420B, 421A/421B of one of the strap brackets 405, 406. The strap brackets 405, 406 secured to the outer appendage 215 are able to slide along the length of the outer appendage 215 to desired positions, allowing the hanging gun support 400 to accommodate guns of different sizes and configurations. The resting member 440 supports the gun 25, and the hunter 35 may rest a hand on the resting member 440 (adjacent to or on the barrel 30 of the gun 25) to aim the gun 25 and hold it steady. The hanging straps 445A, 445B permit the hunter 35 to rotate the resting member 440 (and thus where the gun 25 is aimed) 180 degrees in either direction, providing a 360-degree field of view. The optional tree stand would allow the hunter 35 to aim the gun 25 from a seated position, potentially keeping the barrel 30 steadier than when standing. A back hanging strap 450 analogously secured to the support arm 200 via strap bracket 407 is able to support the back end of the gun 25 so that the hunter 35 does not have to hold the gun 25 when not using it. (Strap bracket 407 analogously includes strap bracket halves 407A/407B, strap bracket hanging portions 417A/417B extending from strap bracket appendage portions 412A/412B, strap bracket strap apertures 422A/422B, strap bracket fastener apertures 427A/427B, strap bracket fastener 432, and strap bracket wing nut 437.) The hanging straps 445A, 445B, 450 are able to prevent the gun 25 from falling even in windy conditions.

Figure 7:
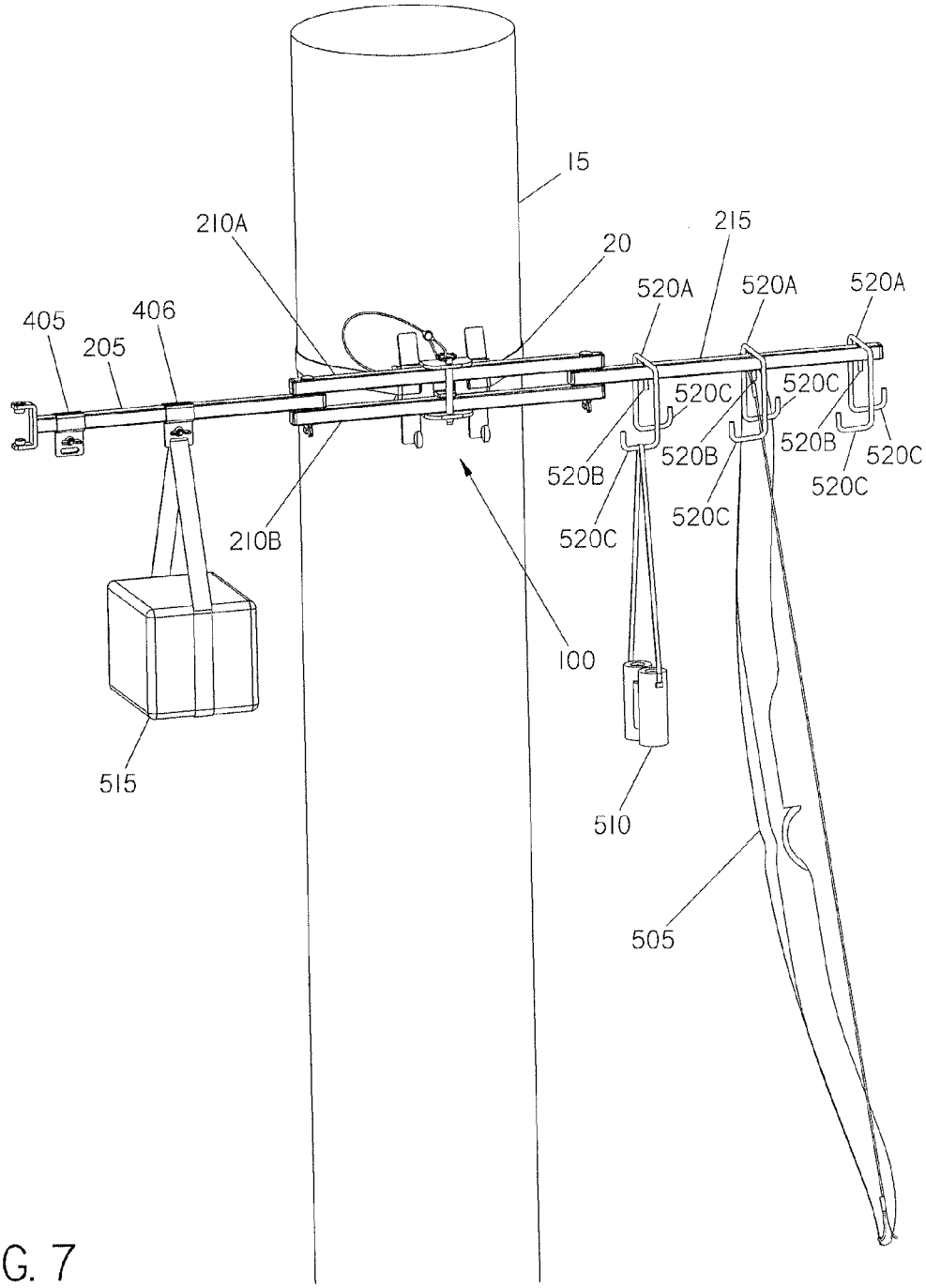
FIG. 7 shows the support arm 200 of FIG. 1 secured to the mounting bracket 100 in an alternative manner to hang equipment and accessories therefrom, with a middle appendage 210A abutting a primary flange 110A within a primary valley 110C, and a middle appendage 210B complementarily received within a secondary valley 115B defined by a primary flange 110B and a secondary flange 115A.

Referring to FIG. 7, the mounting bracket 100 can be used to secure the support arm 200 to the tree 15 without using the support arm bracket 225A of the inner appendage 205. The middle appendages 210A, 210B of the support arm 200 can be received within the primary valley 110C. Specifically, the middle appendage 210A abuts the primary flange 110A, and the middle appendage 210B abuts the primary flange 110B. The middle appendage 210B complementarily fits within the secondary valley 115B, and the middle appendages 210A, 210B are able to laterally slide within the primary valley 110C to change the separation between the inner and outer appendages 205, 215 with respect to the mounting bracket 100. The elongated pin 145A can be inserted through the opposing primary flange apertures 112A, 112B to removably secure the appendage to the mounting bracket 100. The support arm 200 can be used to hang equipment and accessories, such as bow 505, binoculars 510, and a storage container 515. The equipment can be, e.g., hung by a strap using one of the strap brackets 405, 406, hung from an accessory hanger 520A, or hung directly from the support arm 200. Each accessory hanger 520A is secured to the support arm 200 by inserting an accessory hanger flange 520B through one of the accessory apertures 310C formed in the appendages. The accessory hanger 520A is rotatable with respect to the long axis of the accessory hanger flange 520B until one of its hanger arms 520C makes contact with the appendage from which it hangs.

Preferred versions of the invention have been reviewed in the foregoing discussion to illustrate different possible features of the invention and the varying ways in which these features may be combined. Apart from combining the different features of the foregoing versions in varying ways, other modifications are also considered to be within the scope of the invention. Following is an exemplary list of such modifications.

Initially, it must be kept in mind that the gun support 10 shown in the accompanying drawings and discussed above are merely exemplary, and may assume a wide variety of configurations different from those noted, and may use components different from those noted. For example, the dimensions of the mounting bracket 100 and its components can vary greatly from those given above, modified to interact with equipment and accessories having any dimensions and configuration. The mounting bracket base 105A and extensions therefrom can have any desired shapes and configurations (e.g., the mounting bracket base 105A may be circular, square, or diamond-shaped rather than rectangular, and the extensions therefrom can analogously have other geometric and non-geometric shapes).

Although using the mounting strap 20 to secure the mounting bracket 100 to the tree 15 avoids damage to the support structure 15, the mounting bracket 100 can alternatively be secured to the support structure 15 using other means (such as by screwing fasteners into the support structure 15). If the mounting strap 20 is used, a ratcheting mechanism, cam buckle, or other adjustable connector allows the mounting cable to be tightened, or loosened for removal or retightening at another height. Although the mounting bracket 100 can be secured to a tree 15 while hunting in the woods, the mounting bracket 100 can similarly be mounted to any structure (such as a utility pole) on which various equipment and accessories are to be supported at desired heights. Moreover, the secondary flange 115A need not be incorporated in the mounting bracket 100, providing no secondary valley 115B for a single appendage to slide therein. The inner appendage 205 may be non-removably integrated with the mounting bracket 100, such that the removable elongated pin 145A would not be used to secure the support arm bracket 225A to the primary flanges 110A, 110B.

The versatile mounting bracket 100 can be secured to the support structure 15 in alternative orientations, such as an inverted orientation (i.e., rotated 180 degrees from the orientation shown in the figures) in which the upper pair of support flanges 125A, 125B is below the lower pair of support flanges 130A, 130B. In the alternative support arm orientation of FIG. 7, any combination of two, three, or four of the inner, middle, and/or outer appendages 205, 210A, 210B, 215 (or only one of them) can be laterally secured to the mounting bracket 100. For example, the inner appendage 205 can be removed to provide a modified support arm 200 in which two middle appendages 210A, 210B and the outer appendage 215 are secured to each other in tandem, with one of the appendages 210A, 210B, 215 being inserted into the complementary secondary valley 115B formed between the secondary flange 115A and one of the primary flanges 110A, 110B (see FIGS. 1 and 2).

None, one or more, or all of the support flanges can be angled with respect to the mounting bracket base 105A, and none, one or more, or all of the support flanges can include support flange apertures 135A, 135B formed therein for receiving leveling fasteners 135C. It is preferable that if a pair of support flanges are angled, the two angled support flanges be on opposing sides of the mounting bracket 100 (e.g., top left and top right, top left and bottom left, top right and bottom right, or bottom left and bottom right) or diagonally oriented (e.g., top left and bottom right or top right and bottom left). Analogously, if a pair of support flanges includes support flange apertures 135A, 135B, it is preferably that the two support flanges having support flange apertures 135A, 135B be on opposing sides or diagonally oriented. Such placement on opposing sides helps provide balance/symmetry as the mounting bracket 100 is mounted to different support structures 15. Any support flanges angled with respect to the mounting bracket base 105A can have angles varying between zero and 180 degrees.

The barrel support member 305A need not have a "U-shape" but instead may have any shape (such as a "V-shape" or a diamond shape) able to stably cradle or otherwise support a portion of the gun 25. Although not pictured, the U-shaped barrel support member 305A (if used) may include folds extending inwards toward the barrel 30 of the gun 25 to help further restrict the barrel's 30 movement and "catch" the gun 25 if dropped to keep it from falling to the ground. The buttstock 40 of the gun 25 need not be supported using the foam-wrapped rear gun rest 330. Instead, a U- or V-shaped (or any other cradling support) gun rest can be used, or a strap may be wrapped about the buttstock 40 and one of the appendages to secure them together. Although a standard camera 325 is pictured in the figures, any audiovisual recording equipment or other accessory can be secured to the accessory appendage 315. For example, a camcorder with an arm used to rotate/tilt the camera 325 can be mounted on the accessory appendage 315, the camera mount 320A, or another suitable connector.

It should also be understood that various terms referring to orientation and position are used throughout this document—e.g., "upper" (as in "upper pair") and lower (as in "lower pair")—are relative terms rather than absolute ones. In other words, it should be understood (for example) that the upper pair of support flanges may in fact be located at the bottom of the mounting bracket base depending on the overall orientation of the mounting bracket. Thus, such terms should be regarded as words of convenience, rather than limiting terms.

Also in the following description, it is to be understood that such terms as "forward," "rearward," "left," "right," "upwardly," "downwardly," and the like are words of convenience and are not to be construed as limiting terms.

Preferred versions of the invention have been described above in order to illustrate how to make and use the invention. The invention is not intended to be limited to these versions, but rather is intended to be limited only by the claims set out below. Thus, the invention encompasses all different versions that fall literally or equivalently within the scope of these claims.

What is claimed is:

1. A gun support including:

a) a mounting bracket mountable to a support structure, the mounting bracket having:

1) a primary valley and a smaller secondary valley, (i) the secondary valley being situated within the primary valley, (ii) whereby a support arm can be complementarily received within the primary and secondary valleys; and 2) at least two support flanges extending from opposing sides of the mounting bracket, the support flanges configured to resist rotation of the mounting bracket with respect to the support structure when the mounting bracket is mounted thereto; and b) a support arm extending from the mounting bracket, the support arm configured to stably support a gun when the mounting bracket is mounted to a support structure.

2. The gun support of claim 1 wherein:

a) the mounting bracket further includes a mounting bracket base having:

1) a pair of primary flanges extending therefrom, the primary flanges forming the primary valley; and 2) a secondary flange extending therefrom, the secondary flange:

(i) being situated between the primary flanges, and (ii) forming a secondary valley with one of the primary flanges, the secondary valley being smaller than the primary valley, and b) the support flanges extend from opposing sides of the mounting bracket base.

3. The gun support of claim 2 further including:

a) a pair of strap apertures formed in the mounting bracket base on opposing sides of the secondary flange; and b) a mounting strap extending through the strap apertures, the mounting strap configured to removably secure the mounting bracket to a support structure.

4. The gun support of claim 2 wherein:

a) the mounting bracket includes an upper pair of support flanges and a lower pair of support flanges, both pairs of support flanges extending from the mounting bracket base, b) each of the upper pair of support flanges is angled away from the primary flanges, and c) each of the lower pair of support flanges is coplanar with the mounting bracket base.

5. The gun support of claim 4 further including a threaded support flange aperture formed in two opposing support flanges, each support flange aperture being able to receive a threaded leveling fastener configured to rotate the mounting bracket with respect to a support structure when the mounting bracket is mounted to the support structure.

6. The gun support of claim 4 further including a pair of gripping projections extending from the mounting bracket base oppositely from the primary and secondary flanges, the gripping projections configured to resist rotation of the mounting bracket when the mounting bracket is mounted to a support structure.

7. The gun support of claim 2 further including an elongated pin having a locking member, wherein:

a) each primary flange includes a primary flange aperture formed therein, b) the support arm includes an inner appendage, a pair of middle appendages, and an outer appendage, 1) the inner appendage terminating in a support arm bracket having a pair of opposing support arm bracket apertures formed therein, 2) the middle appendages pivotally sandwiching portions of the inner appendage and the outer appendage, and c) the elongated pin extends through the primary flange apertures and the support arm bracket apertures and pivotally secures the inner appendage to the mounting bracket via the locking member.

8. The gun support of claim 7 further including:

a) a support member grip extending upwards from the outer appendage;

b) a barrel support member extending upwards from the barrel support member grip, the barrel support member configured to limit the movement of a gun barrel positioned therein; and c) an accessory appendage extending from the barrel support member, the accessory appendage configured to stably secure a camera pointed in the direction of the gun barrel.

9. The gun support of claim 1 wherein:

a) the support arm includes an inner appendage, a pair of middle appendages, and an outer appendage, b) two spaced strap brackets are removably secured to the outer appendage, and c) two hanging straps extend between opposing ends of a resting member to form a loop therewith, 1) the resting member having a valley formed therein, the valley shaped to complementarily receive a gun barrel, 2) each hanging strap being removably secured to the outer appendage via one of the strap brackets.

10. A gun support including:

a) a mounting bracket secured to a support structure, the mounting bracket configured to be removably secured to a support arm, wherein the mounting bracket includes a mounting bracket base having:

1) a base front surface and an opposing base back surface, and 2) a pair of spaced primary flanges extending out from the base front surface, the primary flanges:

(i) forming a primary valley therebetween, and (ii) being configured to complementarily receive support arm appendages therebetween;

b) a support arm extending from the mounting bracket, the support arm having:

1) two middle appendages sandwiching portions of an inner appendage and an outer appendage, (i) the inner appendage pivotally secured to the mounting bracket, (ii) the middle appendages pivotally secured to the inner and outer appendages, 2) a barrel support member extending upwards from the outer appendage, the barrel support member shaped to complementarily receive and stabilize the barrel of a gun on top of the support arm;

c) an elongated pin extending between the primary flanges, the elongated pin having a locking member, wherein:

1) each primary flange includes a primary flange aperture formed therein, 2) the inner appendage includes a support arm bracket having a support arm bracket aperture formed therein, and 3) the removable pin:

(i) extends through the primary flange apertures and the support arm bracket aperture, and (ii) removably secures the support arm to the mounting bracket via the locking member; and d) a secondary flange extending out from the base front surface, the secondary flange:

1) being situated between the pair of primary flanges, and 2) extending out from the base front surface to a lesser distance than the pair of primary flanges.

11. The gun support of claim 10 further including a pair of gripping projections extending out from the base back surface, the pair of gripping projections being:

a) situated on opposing sides of the mounting bracket; and b) configured to stabilize the mounting bracket mounted to the support structure.

12. The gun support of claim 10 wherein:

a) the inner, middle, and outer appendages of the support arm have the same width, b) the pair of primary flanges are spaced from each other by a distance at least three times the width of the support arm appendages, and c) the secondary flange is spaced from one of the primary flanges by a distance substantially equal to the width of one of the support arm appendages whereby the secondary valley can complementarily receive one of the support arm appendages.

13. The gun support of claim 12 further including:

a) a pair of spaced strap apertures formed in the mounting bracket base, 1) each strap aperture extending from the base front surface to the base back surface, 2) the pair of strap apertures being situated:

(i) between the primary flanges, and (ii) on opposing sides of the secondary flange; and b) a mounting strap, 1) the mounting strap extending:

(i) through the pair of strap apertures and (ii) about the support structure to which the mounting bracket is mounted, 2) the mounting strap being configured to secure the mounting bracket to the support structure.

14. A gun support including:

a) a mounting bracket having a rectangular mounting bracket base with a base front surface and an opposing base back surface;

b) a pair of primary flanges extending out from the base front surface, 1) the primary flanges situated on opposing sides of the mounting bracket base, 2) the primary flanges forming a primary valley configured to complementarily receive a portion of a support arm;

c) a pair of upper support flanges and a pair of lower support flanges, 1) the two pairs of support flanges extending from the four corners of the mounting bracket base, 2) the support flanges being configured to resist rotation of the mounting bracket with respect to a support structure when the mounting bracket is mounted to the support structure; and d) a support arm extending from the mounting bracket, 1) the support arm having an inner appendage, a middle appendage, and an outer appendage, 2) the inner appendage being pivotally secured to the mounting bracket, and 3) the middle appendage being pivotally affixed to both the inner and outer sections.

15. The gun support of claim 14 further including a pair of threaded leveling fasteners, wherein:

a) the upper flanges are angled with respect to the mounting bracket base such that the upper flanges extend away from the base front surface, b) the pair of lower support flanges is at least substantially coplanar with the mounting bracket base, c) two of the support flanges include a threaded support flange aperture formed therein, and d) the threaded leveling fasteners are configured to tilt the mounting bracket by:

1) extending through the support flange apertures to varying degrees, and 2) making contact with a support structure on which the mounting bracket is mounted.

16. The gun support of claim 15 further including a secondary flange extending perpendicularly out from the base front surface, wherein:

a) the primary flanges are spaced so that the primary valley is at least 2.5 inches tall, and b) the secondary flange is:

1) situated between the pair of primary flanges and 2) spaced so that the secondary valley is at least 0.625 inches tall.

17. The gun support of claim 16 further including:

a) a pair of gripping projections extending out from the base back surface, the pair of gripping projections situated on opposing sides of the mounting bracket base;

b) an elongated pin extending between the primary flanges and through primary flange apertures formed therein, the elongated pin having a ball detent configured to removably secure the support arm to the mounting bracket;

c) a barrel support member extending upwards from the outer appendage, the barrel support member shaped to complementarily receive and stabilize a gun barrel over the outer appendage during hunting; and d) an accessory appendage extending from the barrel support member, the accessory appendage configured to stably secure a camera pointed in the direction of the gun barrel.

18. A gun support including a mounting bracket mountable to a support structure, the mounting bracket including:

a) a mounting bracket base having:

1) a pair of primary flanges extending therefrom to form a primary valley; and 2) a secondary flange extending therefrom, the secondary flange being situated between the primary flanges to form a smaller secondary valley within the primary valley;

b) an upper pair of support flanges extending upwards from the mounting bracket base, and a lower pair of support flanges extending downwards from the mounting bracket base, 1) each of the upper pair of support flanges being angled away from the primary flanges, and 2) each of the lower pair of support flanges being coplanar with the mounting bracket base.

19. The gun support of claim 18 further including a threaded support flange aperture formed in each of the lower pair of support flanges, a) each support flange aperture being able to receive a threaded leveling fastener to varying degrees, b) each leveling fastener increasingly pressing against the support structure as it extends through the support flange aperture.

20. The gun support of claim 19 further including a pair of gripping projections extending from the mounting bracket base oppositely from the primary and secondary flanges, the gripping projections configured to resist rotation of the mounting bracket when the mounting bracket is mounted to a support structure.

21. The gun support of claim 20 further including:

a) a pair of strap apertures formed in the mounting bracket base on opposing sides of the secondary flange; and b) a mounting strap extending through the strap apertures, the mounting strap configured to removably secure the mounting bracket to a support structure.

22. The gun support of claim 21 further including:

a) a support arm pivotally secured to the mounting bracket;

b) a support member grip extending upwards from the support arm, the support member grip configured to be gripped by a hunter to pivot the support arm with respect to the mounting bracket; and c) a barrel support member extending upwards from the barrel support member grip, the barrel support member configured to complementarily receive the barrel of a gun.

* * * * *